US005755630A

United States Patent [19]

Malwitz

[11] Patent Number: 5,755,630

[45] Date of Patent: May 26, 1998

[54] BATTING PRACTICE DEVICE

[76] Inventor: Lonnie D. Malwitz, 9840 250th St. W., Lakeville, Minn. 55044

[21] Appl. No.: 505,584

[22] Filed: Jul. 21, 1995

Related U.S. Application Data

[63] Continuation of Ser. No. 153,320, Nov. 16, 1993, abandoned, which is a continuation-in-part of Ser. No. 988,772, Dec. 10, 1992, Pat. No. 5,271,618.

[51] Int. Cl.[6] ..... A63B 69/00

[52] U.S. Cl. ..... 473/429

[58] Field of Search ..... 473/393, 423, 473/426, 429, 430; 273/317.8

[56] References Cited

U.S. PATENT DOCUMENTS

| | | | |
|---|---|---|---|
| 2,751,226 | 6/1956 | Conway | 473/427 |
| 2,976,040 | 3/1961 | Bales | 473/429 |
| 3,593,998 | 7/1971 | Pattyn | 473/30 |
| 3,830,494 | 8/1974 | Biskup | 273/26 E |
| 4,010,950 | 3/1977 | Visockis | 273/26 E |
| 4,050,694 | 9/1977 | Domroski | 273/26 E |
| 4,093,234 | 6/1978 | Barton | 273/200 R |
| 4,095,798 | 6/1978 | Marple | 273/200 R |
| 4,097,044 | 6/1978 | Miniere | 273/26 R |
| 4,451,036 | 5/1984 | Sinclair | 273/26 R |
| 4,647,042 | 3/1987 | Bruce | 473/30 |
| 4,664,375 | 5/1987 | Tetreault | 273/26 E |
| 4,702,866 | 10/1987 | Krueger | 264/46.4 |
| 4,793,612 | 12/1988 | Hammond | 473/429 |
| 4,828,262 | 5/1989 | Henley | 273/26 E |
| 4,898,385 | 2/1990 | Love | 273/26 E |
| 5,000,450 | 3/1991 | Beintema | 473/429 |

FOREIGN PATENT DOCUMENTS

| | | |
|---|---|---|
| 493661 | 10/1938 | United Kingdom . |
| 2401055 | 7/1975 | United Kingdom . |

*Primary Examiner*—Theatrice Brown

*Attorney, Agent, or Firm*—Palmatier, Sjoquist, Helget & Voigt, P.A.

[57] ABSTRACT

A batting practice device is attachable to any of various existing permanent fixtures, suitably a post. The device includes a mounting bracket attachable to the fixture, the bracket supporting a receiving tube. The tube has an opening for interlockably receiving a rod with a portion extending from the bracket in a cantilevered horizontal fashion. A metal bushing is rotatably mounted and captured on the rod portion extending from the plate. A piece of rope has a first and second end. A ball is provided. The first end of the rope is affixed to the ball. The second end is secured to the bushing.

4 Claims, 6 Drawing Sheets

10
16
23
27
29
37
35
B
A
41
43
45
38
46
72
56
25
29
37
35

38
41
45
43
37
37
35

BATTING PRACTICE DEVICE

This application is a continuation of prior filed and abandoned co-owned application Ser. No. 08/153,320 filed on Nov. 16, 1993 (abandoned), which is a continuation-in-part of prior filed application Ser. No. 07/988,772 filed on Dec. 10, 1992, now issued U.S. Pat. No. 5,271,618.

BACKGROUND OF THE INVENTION

This invention relates to a batting practice device, and more particularly, to an improved batting practice device that is portable more inexpensive, durable and long lived than other prior batting practice device.

In general, such batting practice devices are a necessary tool to permit a ball player to practice daily, if desired, hitting a ball within the hittable strike zone for the baseball player. These devices permit the user to train his body, arms and eyes. An observer may coach the user with respect to the proper body stance and balance in learning and adapting the proper body mechanics for batting. With the aid of batting practice devices, an individual can learn to transfer his weight into hitting the ball, to slug the ball hard, to become a switch hitter and to develop confidence in a sense to see, hear and feel the crisp hard hit of a correctly batted ball.

There are, of course, many baseball and softball batting practice devices known in the prior art. The prior art devices are not completely satisfactory in all respects and do not provide the same flexibility, portability and overall advantages of the present invention. Such prior art devices are quite extravagant and complex rendering them quite expensive and not readily available to the average young baseball player for practice at home. Other types of batting devices appear somewhat flimsy and not durable thereby having a shortened life when compared to the present invention.

There is a need for a batting practice device that is easy to manufacture and relatively inexpensive, thereby making it available to young players as well as the older avid baseball and softball player enthusiast. The device must be of a durable construction as to not deteriorate or wear out upon the practicing hitters repeated inability to not directly hit the ball, but to hit other parts of the device. The device, therefore, must not only be durable but be of a long life construction that can take the hard abuse that the a training and learning baseball player may inflict on the batting practice device.

SUMMARY OF THE INVENTION

A batting practice device is attachable to any of various existing permanent fixtures, suitably a post. The device includes a mounting bracket attachable to the fixture, the bracket supporting a receiving tube. The tube has an opening for interlockably receiving a rod with a portion extending from the bracket in a cantilevered horizontal fashion. A metal bushing is rotatably mounted and captured on the rod portion extending from the plate. A piece of rope has a first and second end. A ball is provided. The first end of the rope is affixed to the ball. The second end is secured to the bushing.

A principle object and advantage of the present invention is that it is of an extremely durable and long lived construction while yet remaining relatively simple, easy and inexpensive to manufacture.

Another object and advantage of the present invention is that the device can be mounted on any of a variety of permanent fixtures, such as a fence, post, building, tree or wall.

Another object and advantage is that the elongate mount bar of the device absorbs the impact, shock, vibration and energy forces transferred through the device which otherwise would be passed on through to the permanent fixture.

Another object and advantage of the present invention is that all or at least portions of the device may be removed from the permanent fixture for safe keeping or transfer to another location.

Other objects and advantages will become readily apparent upon review of the following figures, specification and appended claims.

DETAILED SPECIFICATION

Figure 1:
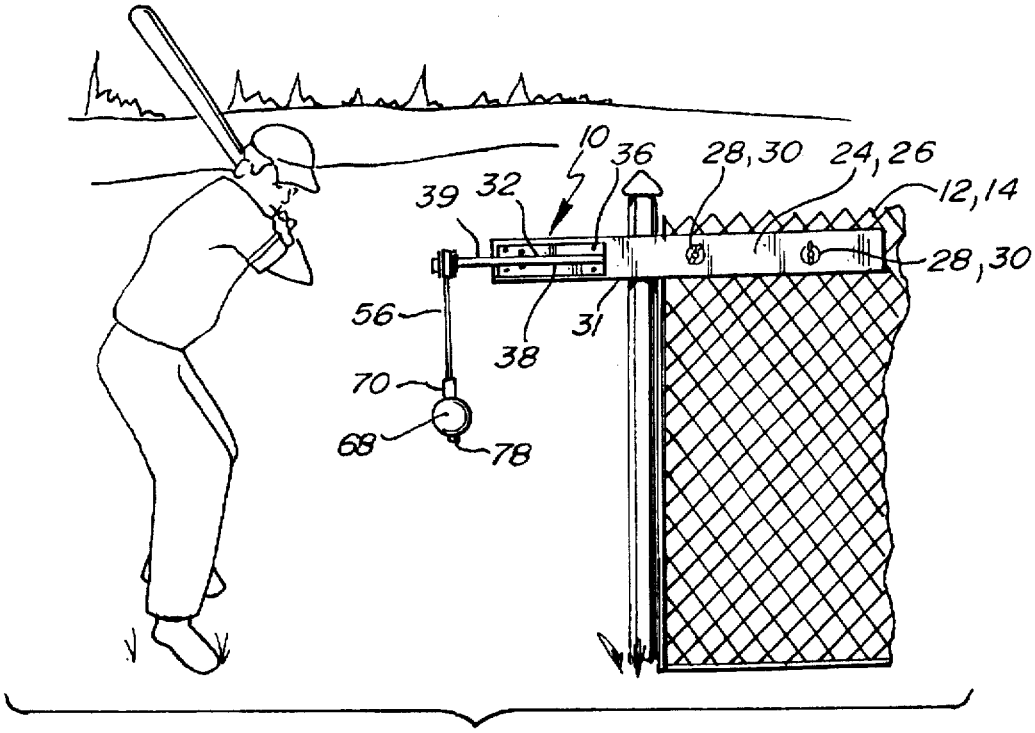
FIG. 1 is a front elevational view of the batting practice device of the present invention being utilized by a batter as the device is affixed to a fence.
Figure 4:
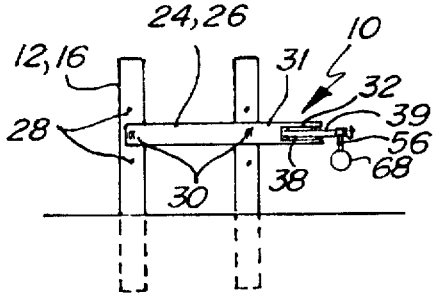
FIG. 4 is a front elevational view of the batting practice device mounted on fence posts.
Figure 5:
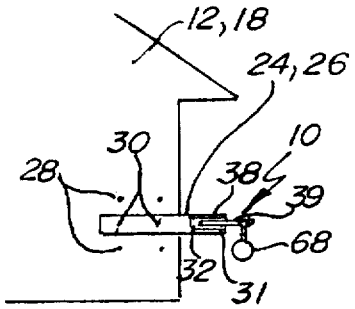
FIG. 5 is a front elevational view of the batting practice device mounted on an exterior wall of a building.
Figure 6:
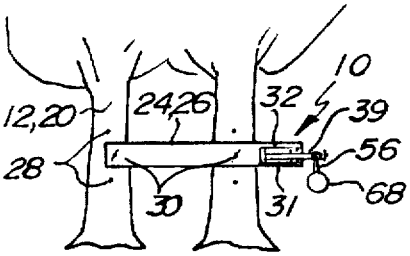
FIG. 6 is a front elevational view of the batting practice device mounted on to two adjacent trees.

The batting practice device 10 of the present invention may generally be seen in FIGS. 1–8. The device attaches to some existing permanent fixtures 12 with a vertical surface for suspending the batting practice device 10. The device includes an elongate mount bar 24, mounting plate 32, pipe 38, metal bushing 46, braided rope 56 and ball 68.

While the detailed structure assembly and operation of the batting practice device 10 is clearly shown in FIGS. 1–3A, samples of permanent fixtures 12 are shown in FIGS. 4–7. Examples of permanent fixtures might include a fence 14, posts 16, building 18, trees 20 and an interior wall 22.

More specifically, the batting practice device 10 includes an elongate mount bar 24 suitably made of a "2×4" board 26 approximately four feet in length. The bar 24 may be made of a variety of materials but Applicant has found that the wooden board 26 readily absorbs the impact, shock, vibration and energy forces which a batter will transfer from his bat (FIG. 1) to the device which otherwise may be transferred to the permanent fixture 12.

The mount bar 24 is appropriately releasably affixed or attached to the permanent fixture 12 by way of six inch hanger bolts 28 or the like. The bolts 28 are appropriately attached to the fixture perhaps in several vertically aligned locations for adjusting the batting practice device 10 either upwardly or downwardly to the strike zone of the user.

Approximately ¾ of the length mount bar 24 is to be mounted flush onto the vertical surface of the permanent fixture 12, where applicable. The bar 24 has apertures therethrough which receive the hanger bolts 28 therethrough. Thereafter washers and wingnuts may be rotatably affixed to the bolts to secure the mount bar 24 to the fixture 12. The mount bar 24 by this arrangement has a bar extending portion 31 approximating ¼ of the length of the overall mount bar 24.

At the bar extending portion 31 is appropriately affixed a mounting plate 32 which suitably is made of a zinc-plated heavy gauge steel. The plate 32 appropriately may be affixed to the bar extending portion 31 by way of screws, bolts or the like 36 at the plate's apertures 34.

Suitably affixed to the mounting plate 32, such as by welding, is a zinc-plated heavy gauge steel rod or pipe 38 which has a pipe extending portion 39 and an aperture 40 through the end of that portion 39. The aperture 40 receives a locking lynch pin 42 while intermediately of the pipe extending portion 39 is a stop washer 44 which is welded to the pipe 38.

A metal bushing 46 is also appropriately made of a zinc-plated heavy gauge steel. The metal bushing 46 may have grease 48 on its inner side for a low friction fit and to add lubrication as the bushing 46 is slid over and rotated on the pipe extending portion, stopped by the stop washer 44 and locked into place the lynch pin 42. The metal bushing 46 preferably has a first loop, ring or eyelet 50 and a generally opposing second loop, ring or eyelet 52 as will be appreciated. Between the bushing 46 and the lynch pin 42 is appropriately located a fender washer 54 to prohibit wear of the pin 42 by the friction of the rotating metal bushing 46.

A braided plastic rope 56 is utilized with this invention and is suitably made of a plastic, nylon or polypropylene material with interweave strands 58. A braided rope 56 of this type typically has a hollow core 60. The rope 56 may have a first end 62 and a second end 64. The rope is to pass through the central aperture 66 of a ball 68, suitably of the equivalent weight of a softball or baseball and appropriately made of ethylene vinyl acetate. The braided rope 56 appropriately is protected by a first vinyl sheath 70 located just above the ball 68 and second vinyl sheath rope guard or protector 72 which surrounds the braided rope at the metal bushing 46 area.

Figure 3:
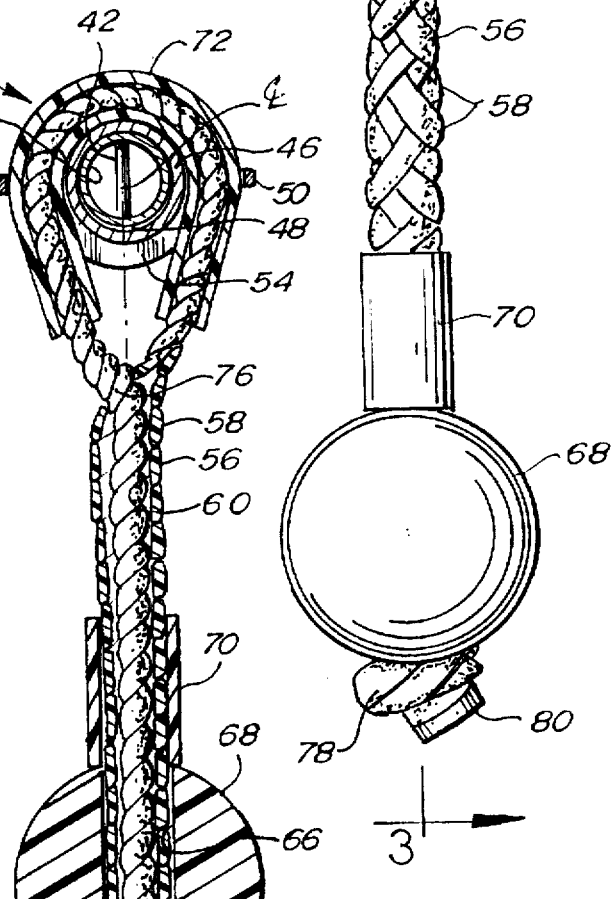
FIG. 3 is a cross-sectional view taken along lines 3—3 of FIG. 2.
Figure 3A:
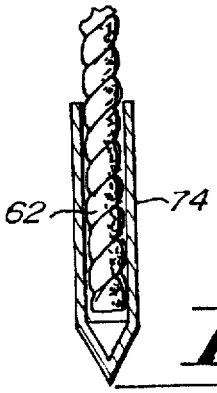
FIG. 3A is a front elevational view of the guide tool utilized in constructing the present invention.
Figures 9, 13:
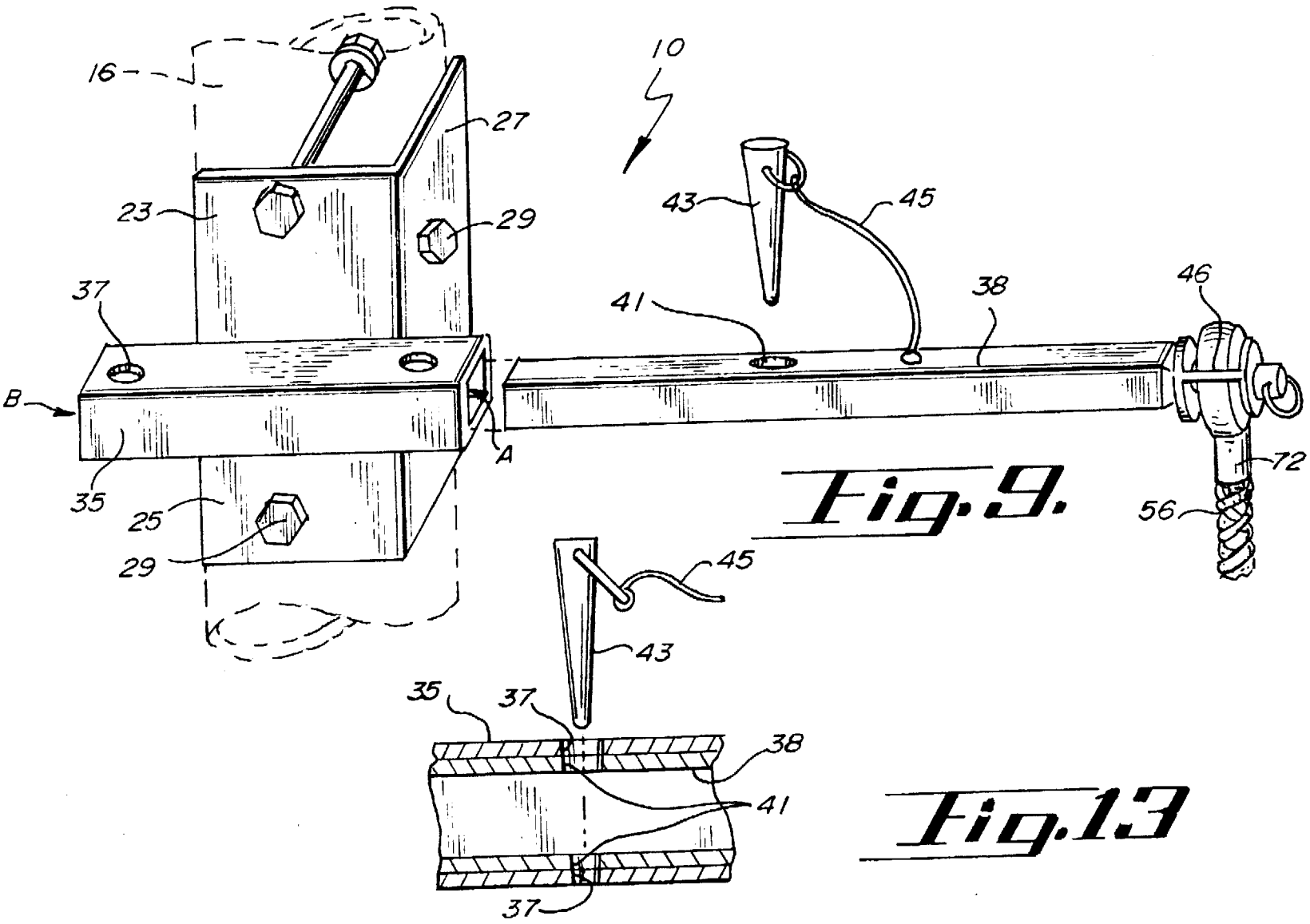
FIG. 9 is a perspective view of a modified mounting structure for the device.
FIG. 13 is an enlarged broken away view of the locking means of the modified device.
Figure 10:
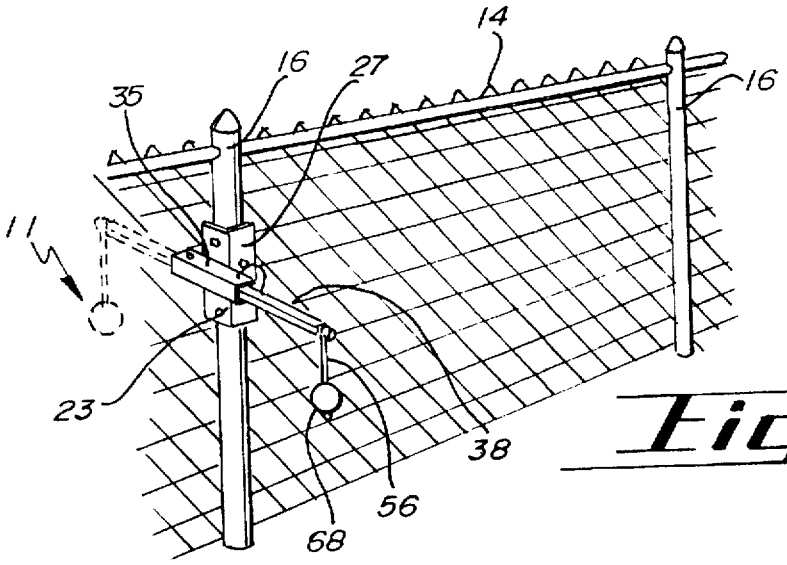
FIG. 10 is a perspective view of the modified device attached to a fence post.
Figure 11:
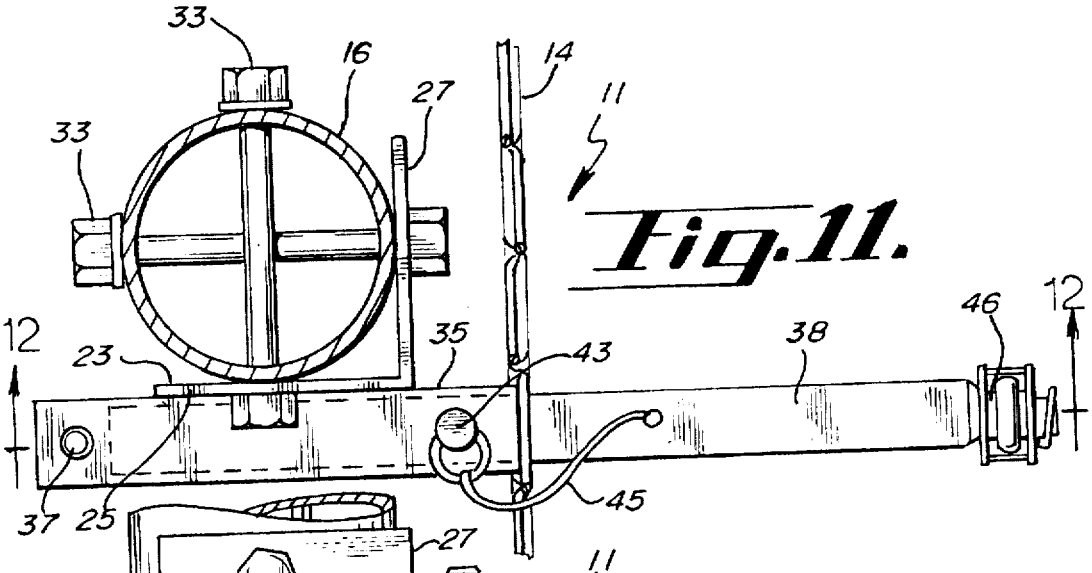
FIG. 11 is a top plan view of the modified device attached to a fence post which is partially broken away.
Figure 12:
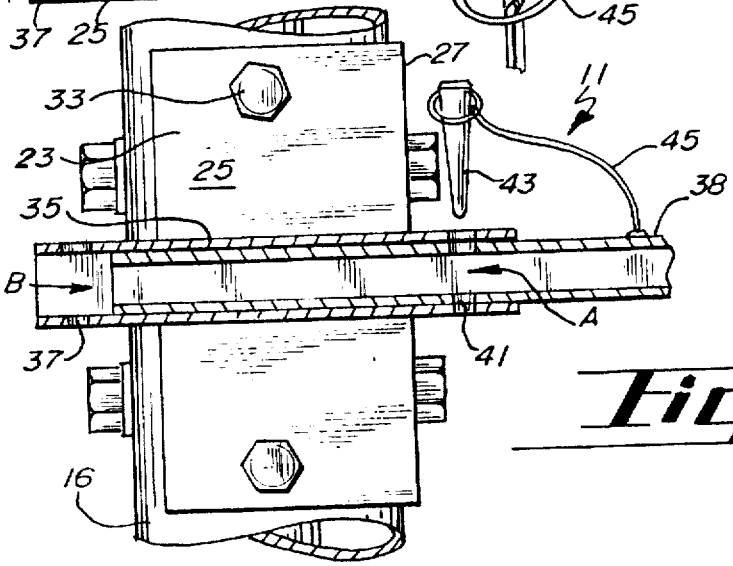
FIG. 12 is a cross sectional view taken along lines 12—12 of FIG. 11.

Referring to FIGS. 3 and 3A, the assembly of the batting practice device 10 may be understood. The first end 62 of braided rope 56 is initially fed through the central apertures 66 of the ball 68. Thereafter the first vinyl sheath 70 is threaded over the first end 62 and slid downwardly to abut the ball 68. The first end 62 is then thread through the second vinyl sheath 72 which together with the braided rope is passed over the metal bushing 46 and through the first and second loops or rings 52. Thereafter, the first end 62 is inserted into the pointed hollow needle or guide tool 74. The pointed tool 74 is then inserted into the hollow core 60 of the braided rope 56 between the interweaved strands 58. The first end is guided along and within the hollow core as it is passed through the central aperture 66 of ball 68. Thereafter a knot 78 if formed suitably at the first 62 and second 64 ends after which the ends are heat sealed 80 together.

Next the lynch pin 42 is removed from the end of pipe 38. The metal bushing 46 is slid onto the pipe extending portion 39 up to the stop washer 44. Thereafter, fender washer 44 is slid onto pipe 38 and lynch pin 42 is again locked onto the pipe 38. The invention thereafter is assembled excepting only the affixation of the mounting plate 32 onto the elongate mount bar 24 or board 26 which in turn is affixed to a permanent fixture 12.

FIGS. 1 and 4 through 7 illustrate the various permanent fixtures 12 that the batting practice device 10 may be releasably connected thereto. It is appropriate to note that a plurality hanger bolts 28 may be vertically aligned as to move the elongate bar 24 either upwardly or downwardly to position the ball 68 in the strike zone of the batting operator.

Referring to FIG. 1, the batting operator, and perhaps a coach, can observe the rotation of the ball 68 and tell if the hit was popped up, pushed, pulled or slugged hard and straight forward from either behind or in front of the operator.

Figure 7:
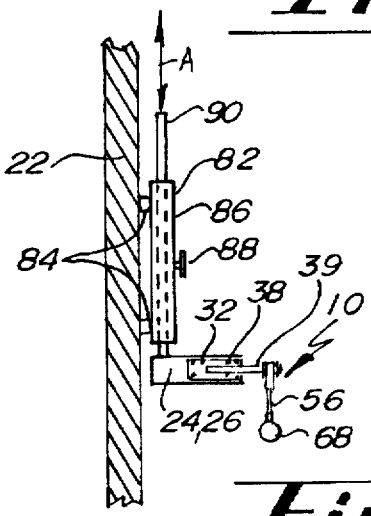
FIG. 7 is a front elevational view of the batting practice device mounted on the interior side of a wall shown in cross-section.
Figure 2:
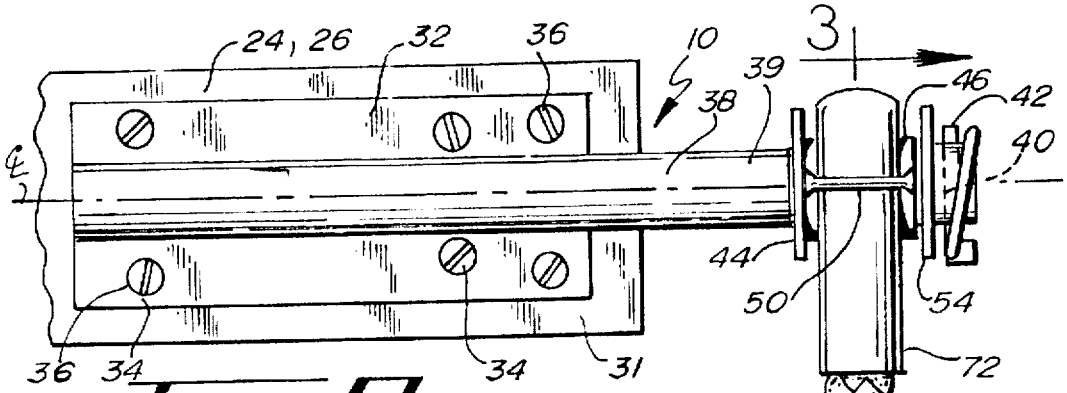
FIG. 2 is a front elevational view of the present invention with the elongate mounting bar broken away.

FIG. 7 shows an adjustable wall mount 82 for the inside of a building such as a gym. Hanger bolts or studs 84 are affixed into the wall 22. The bolts or studs 84 appropriately support an outer tube or sleeve 86 in a secure manner. Sleeve 86 supports a set screw with a handle 88. A device support rod 90 passes through the sleeve 86 and is adjustably held in vertical position by the inward turning of the set screw 88. Arrow A illustrates that the device support rod 90 may be moved upwardly or downwardly to appropriately position the ball 68 in the user's strike zone.

Figure 8:
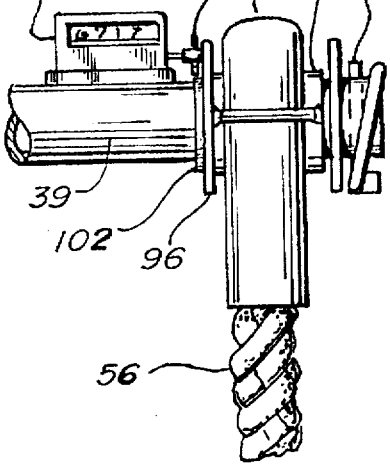
FIG. 8 is a front elevational view of the batting practice device partially broken away showing a revolution counter mechanism mounted thereon.

Referring to FIG. 8, the present invention may be fitted with a counter 94. Counter 94 is appropriately affixed to the pipe 38 adjacent a collar or washer 102 which takes the place of former stop washer 44. In place of former stop washer 44, a washer 96 is fixed to bushing 46 and supports a cog 98. As bushing 46 rotates about pipe 38, the cog 98 extending from washer 96 engages the sprocket of counter 100.

By this arrangement, the user or batting practitioner may count the number of revolutions of both the ball 68 and the bushing 46 to ascertain the force that the user has hit the ball 68. It is also appropriate that ball 68 be of substantially the same weight as a real baseball or softball to give the user the sensation of actually hitting a real ball.

Referring to FIGS. 9–13, a modified batting practice device 11 may be viewed. Device 11 is suitably mountable on a fence 14 appropriately about a post 16. Mount means may include a mount bar 24, mounting plate 32 and rod 38, as previously discussed, or mounting bracket 23, receiving tube 35 and rod 38.

More specifically, the modified device 11 would include an angle iron piece portion described as a mounting bracket 23. The mounting bracket has a face side 25 and a sidewall side 27 appropriately at 90° from each other. The face 25 and sidewall 27 suitably have alignable and opposing apertures 29 to receive four arrangements of bolt and nuts 33 to securely fasten the mounting bracket 23 to post 16 by eight secure points.

Mounting bracket 23 supports a receiving tube 35 having two openings A and B. Receiving tube 35 also has vertically oriented apertures 37 which are suitably canted or beveled and larger on the top portion of tube 35 than on the bottom portion. One aperture 37 will suffice.

A rod 38 is slidably receivable within receiving tube 35 either from opening A or B depending upon the user's preference. The rod 38 also has apertures 41 therethrough which are suitably canted or beveled and of a slightly smaller diameter than apertures 37 of the receiving tube 35 for a perfectly alignable arrangement. A locking pin 43 suitably is tapered to the same degree as the bevelling of apertures 37 and 41. By this arrangement, locking pin 43 will securely fit within apertures 37 and 41 in an arrangement that will not loosen with time but will remain secure through extended use as the locking pin 43 further seats within apertures 37 and 41. An attachment means 45, suitably a cord or a chain, secures the locking pin 43 to the rod 38 as to prevent its loss.

Rod 38 also appropriately has a metal bushing 46 supporting a rope 56, ball 68 and vinyl sheath 72 as previously described. By this arrangement, the user may place the batting practice device 11 in one of at least two directions with respect to openings A and B in tube 35.

Figure 14:
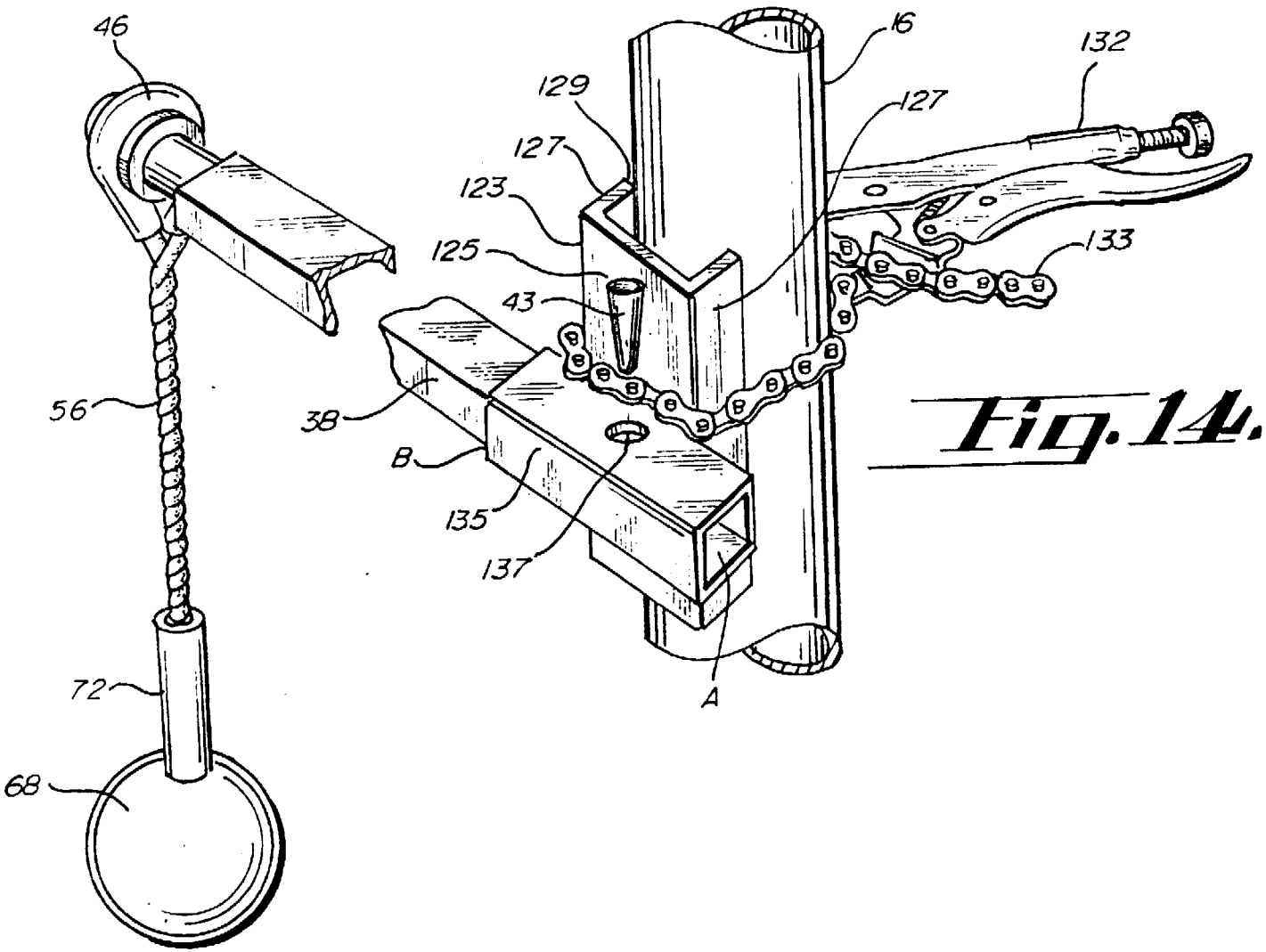
FIG. 14 is a perspective view of the receiving tube with an expandable modified mounting bracket and pipe grip completely removable from the permanent fixture.
Figure 15:
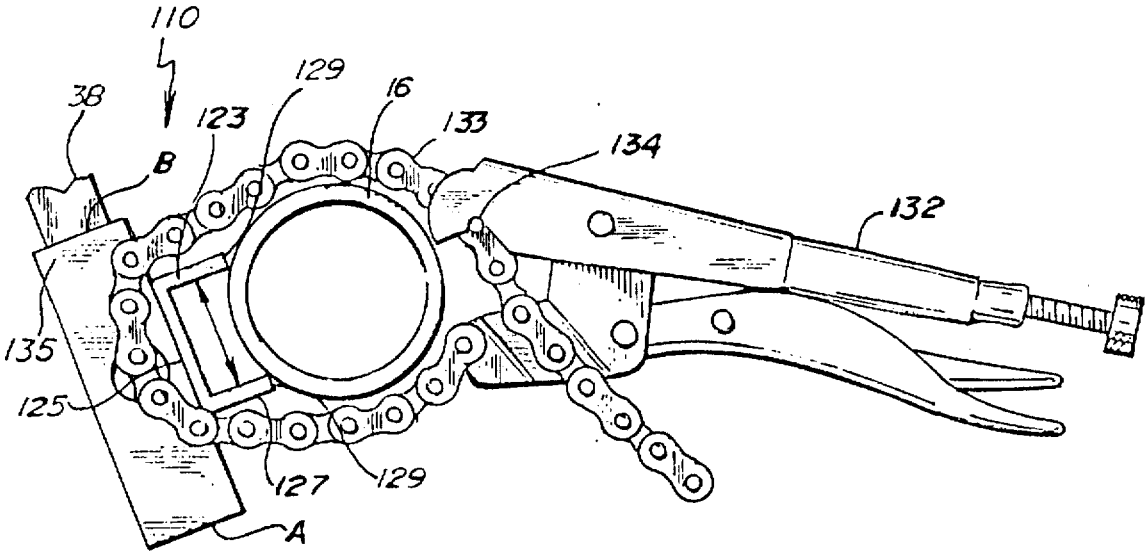
FIG. 15 is a top plan view of the modified device of FIG. 14.

Referring to FIGS. 14 and 15, a second modified batting practice device 110 may be seen that is easily and readily affixable to post 16. The second modified batting practice device 110 is completely removable from post 16 without leaving any components affixed to the post 16. More specifically, an expandable mounting bracket 123 is utilized that is generally u-shaped in cross section having a face 125 and side walls 127. A pipe grip 132 (similar to a vice grip), has a chain 133 and a catch 134 for tightening and securing the chain 133. As the pipe grip 132 is tightened, side walls 127 expand (double-headed arrows in FIG. 15) and side wall ends 129 bite into post 16 to securely and portably secure the batting practice device to post 16.

On face 125 of mounting bracket 123 is secured, suitably by welding, a receiving tube 135 having openings A and B. Receiving tube 135 also has an aperture 137 therethrough. Rod 138 appropriately is slidably receivable into openings A or B and may have an aperture (41 shown in FIG. 9) which is alignable with aperture 137 in the receiving tube after which an interlockable pin 43 (FIG. 9) may be secured.

By this arrangement, the second modified batting practice device 110 is completely portable without securing any components permanently to a post 16. This structure is highly desirable for a coach who travels with his equipment to various locations for teaching young baseball players.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A batting practice device attachable to an existing permanent post comprising:

(a) a mounting bracket attachable to said post, the mounting bracket supporting a receiving tube extending horizontally across the bracket with two opposing openings and vertically oriented apertures in the receiving tube;

(b) a rod having one end slidably receivable into one of the openings of the tube with a rod aperture alignable with one of the receiving tube apertures;

(c) a locking pin positionable in the apertures;

(d) a bushing rotatably mounted and captured on another end of said road extending from said mounting bracket;

(e) a rope connected to said bushing, said rope having a first end; and (f) a ball, said first end of said rope being affixed to said ball.

2. The batting practice device of claim 1 wherein the mounting bracket is of a u-shaped channel expandable about and grippable to the post.

3. The batting practice device of claim 2, further comprising a pipe grip with a chain for expanding and securing the mounting bracket onto the post.

4. A batting practice device attachable to an existing permanent post comprising:

(a) an expandable u-shaped mounting bracket with side wall ends to engage said post, the mounting bracket supporting a receiving tube extending horizontally across the bracket with two openings and vertically-oriented apertures in the receiving tube;

(b) a pipe grip with a chain for expanding and securing the mounting bracket onto the post;

(c) a rod having one end slidably receivable into one of the openings of the tube with a rod aperture alignable with one of the receiving tube apertures;

(d) a locking pin positionable in the apertures;

(e) a bushing rotatably mounted and captured on another end of said rod extending from said mounting bracket;

(f) a rope connected to said bushing, said rope having a first end; and (g) a ball, said first end of said rope being affixed to said ball.

* * * * *